US010731641B2

(12) United States Patent
Treml et al.

(10) Patent No.: US 10,731,641 B2
(45) **Date of Patent: *Aug. 4, 2020**

(54) DIAPHRAGM PUMP WITH SENSOR MOUNT

(71) Applicant: Ingersoll-Rand Industrial U.S., Inc., Davidson, NC (US)

(72) Inventors: Dale Treml, Charlotte, NC (US); John Conrad, Troutman, NC (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 871 days.

This patent is subject to a terminal disclaimer.

(21) Appl. No.: 15/069,184

(22) Filed: Mar. 14, 2016

(65) Prior Publication Data

US 2016/0201663 A1 Jul. 14, 2016

Related U.S. Application Data

(63) Continuation-in-part of application No. 13/741,057, filed on Jan. 14, 2013, now Pat. No. 9,284,956.

(51) Int. Cl.
*F04B 43/073* (2006.01)
*F04B 53/16* (2006.01)
(Continued)

(52) U.S. Cl.
CPC ..... *F04B 43/0736* (2013.01); *F04B 39/0061* (2013.01); *F04B 43/0009* (2013.01);
(Continued)

(58) Field of Classification Search
CPC ..... F04B 39/0061; F04B 43/026; F04B 43/0736; F04B 53/16; F04B 53/22;
(Continued)

(56) References Cited

U.S. PATENT DOCUMENTS 4,705,459 A 11/1987 Buisine et al.
4,879,440 A 11/1989 Lymburner
(Continued)

FOREIGN PATENT DOCUMENTS

CN 1865702 11/2006
DE 3246731 6/1984
(Continued)

OTHER PUBLICATIONS

Automation Direct, "Sensors," Oct. 2012, pp. e18-15, e18-16, vol. 14, 2 pages.
(Continued)

*Primary Examiner* — Alexander B Comley
(74) *Attorney, Agent, or Firm* — Taft Stettinius & Hollister LLP

(57) ABSTRACT

Illustrative embodiments of diaphragm pumps including a sensor mount are disclosed. In one illustrative embodiment, a diaphragm pump may include a shaft disposed within a pump housing and coupled to at least one diaphragm, a mount removably attached to the pump housing and having a sensor receptacle, and a proximity sensor received in the sensor receptacle of the mount such that a sensing end of the proximity sensor is flush with an end of the sensor receptacle nearest the shaft.

16 Claims, 12 Drawing Sheets

(51) Int. Cl.

| | |
|---|---|
| ***F04B 53/22*** | (2006.01) |
| ***F04B 39/00*** | (2006.01) |
| ***F04B 43/02*** | (2006.01) |
| ***F04B 43/00*** | (2006.01) |
| ***F04B 45/053*** | (2006.01) |
| ***F04B 43/06*** | (2006.01) |
| ***F04B 53/00*** | (2006.01) |

(52) U.S. Cl.
CPC ..... *F04B 43/026* (2013.01); *F04B 43/06* (2013.01); *F04B 45/0536* (2013.01); *F04B 53/16* (2013.01); *F04B 53/22* (2013.01); *F04B 53/001* (2013.01); *F04B 2201/0201* (2013.01)

(58) Field of Classification Search
CPC ..... F04B 2201/0201; F04B 39/0055–0072; F04B 43/0009; F04B 43/06–0736; F04B 43/10–1136; F04B 45/033–045; F04B 45/053–064; F04B 45/073–0736
USPC ..... 324/633, 654; 417/312, 389, 395
See application file for complete search history.

(56) References Cited

U.S. PATENT DOCUMENTS

| | | | | |
|---|---|---|---|---|
| 5,257,914 | A * | 11/1993 | Reynolds | F04B 43/067 417/293 |
| 5,816,778 | A * | 10/1998 | Elsey, Jr. | F04B 43/0736 417/46 |
| 6,106,246 | A * | 8/2000 | Steck | F04B 7/04 417/395 |
| 6,168,387 | B1 | 1/2001 | Able et al. | |
| 6,190,136 | B1 * | 2/2001 | Meloche | F04B 43/009 417/395 |
| 6,209,678 | B1 | 4/2001 | Sterling | |
| 6,241,487 | B1 * | 6/2001 | Reynolds | F04B 43/0736 137/625.6 |
| 6,280,149 | B1 * | 8/2001 | Able | F04B 43/0736 417/395 |
| 6,829,542 | B1 | 12/2004 | Reynolds et al. | |
| 6,906,527 | B1 * | 6/2005 | Niimi | H01R 13/6683 324/207.15 |
| 6,957,952 | B1 * | 10/2005 | Steck | F04B 43/0736 417/395 |
| 7,456,385 | B2 | 11/2008 | Engstrand | |
| 7,631,725 | B2 * | 12/2009 | Towne | F04B 43/0736 181/230 |
| 7,779,962 | B2 | 8/2010 | Zhang | |
| 7,825,655 | B1 * | 11/2010 | Stabel | G01B 7/14 324/207.15 |
| 8,628,307 | B2 | 1/2014 | Lilie | |
| 9,284,956 | B2 | 3/2016 | Treml et al. | |
| 2007/0148028 | A1 * | 6/2007 | Lilie | F04B 39/1066 418/2 |
| 2007/0266846 | A1 * | 11/2007 | Simmons | F04B 43/067 91/218 |
| 2007/0297926 | A1 | 12/2007 | Wang et al. | |
| 2008/0302596 | A1 | 12/2008 | Harrington | |
| 2010/0196168 | A1 * | 8/2010 | Kozumplik | F04B 43/0736 417/1 |
| 2010/0216343 | A1 * | 8/2010 | Buschnakowski | G01D 21/00 439/620.01 |
| 2011/0285406 | A1 * | 11/2011 | Reetmeyer | G01D 5/20 324/654 |

FOREIGN PATENT DOCUMENTS

| | | |
|---|---|---|
| DE | 20104631 | 7/2001 |
| EP | 0271878 | 6/1988 |
| WO | 2010088007 | 8/2010 |

OTHER PUBLICATIONS

Ingersoll Rand Company Ltd, "Operator's Manual," Sep. 15, 2011, pp. 1-12.
Graco, Inc., "Reed Switch and Solenoid Kits 24B771 and 24B772," Aug. 2009, pp. 1-2.
State Intellectual Property Office, First Office Action in PRC (China) Patent Application No. 201310721934.X, dated Sep. 6, 2015, 13 pages. (with translation).
European Patent Office, Extended European Search Report for EP13196420, dated Apr. 2, 2014, 6 pages.
Ingersoll-Rand Co., "Operator's Manual" for PE03X-XXX-XXX-XXXX, PE05X-XXX-XXX-XXXX, and PE07X-XXX-XXX-XXXX, Dec. 1, 2015, 8 pages.
Ingersoll-Rand Co., "Operator's Manual" for PE10X-XXX-XXX-XXXX, PE15X-XXX-XXX-XXXX, PE20X-XXX-XXX-XXXX, and PE30X-XXX-XXX-XXXX, Dec. 1, 2015, 12 pages.
Ingersoll-Rand Co., "Operator's Manual" for PE01X-XXX-XXX-AXXXX, Dec. 1, 2015, 12 pages.

* cited by examiner

DIAPHRAGM PUMP WITH SENSOR MOUNT

CROSS-REFERENCE TO RELATED APPLICATION

This application is a continuation-in-part of U.S. patent application Ser. No. 13/741,057, filed on Jan. 14, 2013, entitled "DIAPHRAGM PUMP WITH MUFFLER-MOUNTED SENSOR," and commonly assigned to the assignee of the present application. The disclosure of the foregoing application is incorporated by reference in its entirety herein.

TECHNICAL FIELD

The present disclosure relates, generally, to diaphragm pumps and, more particularly, to diaphragm pumps including a sensor mount.

BACKGROUND

Diaphragm pumps typically include a shaft, or diaphragm rod, that moves reciprocally between end of stroke positions to cause one or more diaphragms coupled to the shaft to modify the volume of one or more associated pump chambers. A sensor may be used to detect the position and/or the movement of the shaft, such as when the shaft reaches one of the end of stroke positions. Information regarding the position and/or the movement of the shaft, obtained from the sensor, may then be utilized in controlling operation of the diaphragm pump. One such design, employing a proximity sensor, is described in U.S. Patent Application Publication No. 2010/0196168 to Kozumplik et al., the entire disclosure of which is incorporated by reference herein. Prior designs, such as that disclosed in the foregoing reference, often require a tedious assembly and adjustment procedure to achieve precise positioning of the sensor relative to the shaft.

SUMMARY

According to one aspect of the present disclosure, a diaphragm pump may include a shaft disposed within a pump housing and coupled to at least one diaphragm; a mount removably attached to the pump housing and having a sensor receptacle; and a proximity sensor received in the sensor receptacle of the mount such that a sensing end of the proximity sensor is flush with an end of the sensor receptacle nearest the shaft.

In some embodiments, the sensor receptacle may include a receptacle housing and a bore defined through the receptacle housing for receiving the proximity sensor.

In some embodiments, the sensor receptacle may include one or more protrusions extending inwardly into the bore from an inner surface of the receptacle housing, the one or more protrusions forming an interference fit with an exterior surface of the proximity sensor to secure the proximity sensor within the sensor receptacle.

In some embodiments, the receptacle housing may be cylindrical and include an exterior surface having a threading disposed thereon, and wherein the mount is removably attached to the pump housing via the threading on the exterior surface of the receptacle housing.

In some embodiments, the pump may include an exhaust chamber defined in the pump housing, wherein the exhaust chamber is configured to receive a motive fluid that has driven reciprocation of the at least one diaphragm and the shaft, and wherein the sensor receptacle of the mount extends into the exhaust chamber.

In some embodiments, the mount may include a body plate, and the sensor receptacle may extend from a side of the body plate.

In some embodiments, the mount may include a muffler receptacle, the muffler receptacle being configured to receive an inlet of an exhaust muffler for fluid connection of the exhaust muffler to the exhaust chamber.

In some embodiments, the muffler receptacle may include a projection extending from the mount away from the shaft and a bore extending through the projection, the bore being configured to receive the inlet of the exhaust muffler.

In some embodiments, the sensor receptacle and the muffler receptacle may extend from opposite sides of the body plate.

In some embodiments, the mount may include at least one fastener opening defined therein, the fastener opening receiving a fastener for securing the mount to the pump housing.

In some embodiments, the proximity sensor may be retained within the sensor receptacle of the mount independently of the mount being removably attached to the pump housing.

According to another aspect of the present disclosure, a method of assembling a diaphragm pump comprising a shaft coupled to at least one diaphragm may include inserting a proximity sensor into a sensor receptacle defined in a mount of the diaphragm pump such that a sensing end of the proximity sensor is flush with an end of the sensor receptacle; and attaching the mount to a pump housing of the diaphragm pump such that the end of the sensor receptacle is positioned at a predetermined distance from the shaft of the diaphragm pump.

In some embodiments, the method may include first inserting the proximity sensor into the sensor receptacle, and second attaching the mount to the pump housing.

In some embodiments, the predetermined distance may be a distance that requires no additional mechanical calibration of the position of the sensor end relative to the shaft.

In some embodiments, inserting the proximity sensor into the sensor receptacle may include aligning the proximity sensor with the sensor receptacle; and pressing the proximity sensor into the sensor receptacle until the sensing end of the proximity sensor is flush with the end of the sensor receptacle.

In some embodiments, pressing the proximity sensor may include forming an interference fit between at least one protrusion of the sensor receptacle and an exterior surface of the proximity sensor.

In some embodiments, the method may include attaching an inlet of a muffler to a pump housing of the diaphragm pump such that the inlet of the muffler is fluidly connected with an exhaust chamber of the diaphragm pump.

In some embodiments, attaching the inlet of the muffler to the pump housing may include inserting the inlet of the muffler into a muffler receptacle defined in the mount.

According to another aspect of the present disclosure, a diaphragm pump may include a shaft disposed within a pump housing and coupled to at least one diaphragm; a proximity sensor for sensing a position of the shaft, the proximity sensor having a sensing end, and means for mounting the proximity sensor to the pump housing such that the sensing end is positioned at a predetermined distance from the shaft when the means is removably attached to the pump housing.

In some embodiments, the means may include a sensor receptacle configured to receive the proximity sensor therein such that the sensing end of the proximity sensor is flush with an end of the sensor receptacle.

In some embodiments, the proximity sensor may be received in the sensor receptacle independently of the means being removably attached to the pump housing.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE DRAWINGS

Figure 1:
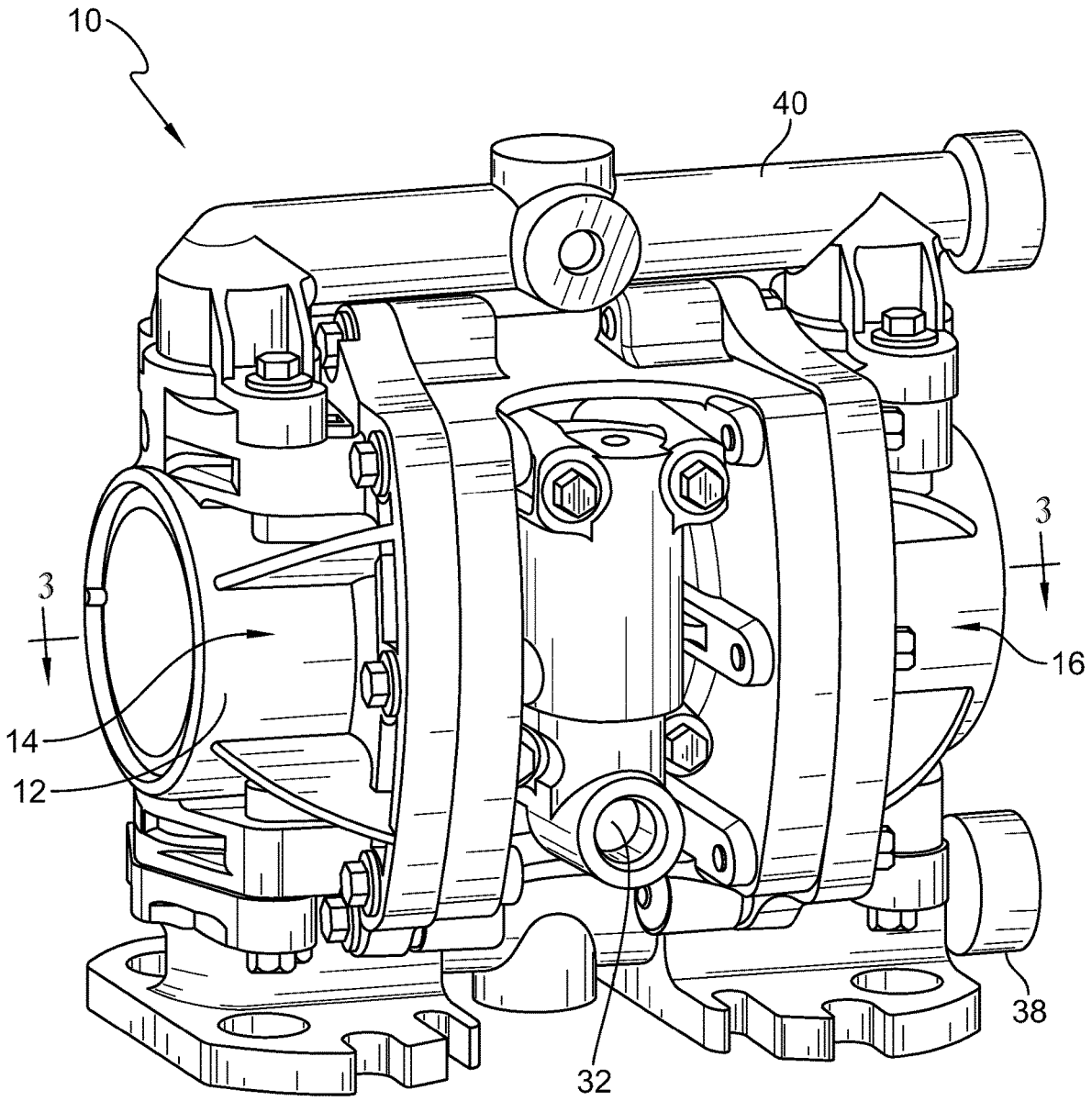
FIG. 1 is a front perspective view of at least one embodiment of a double diaphragm pump.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 2:
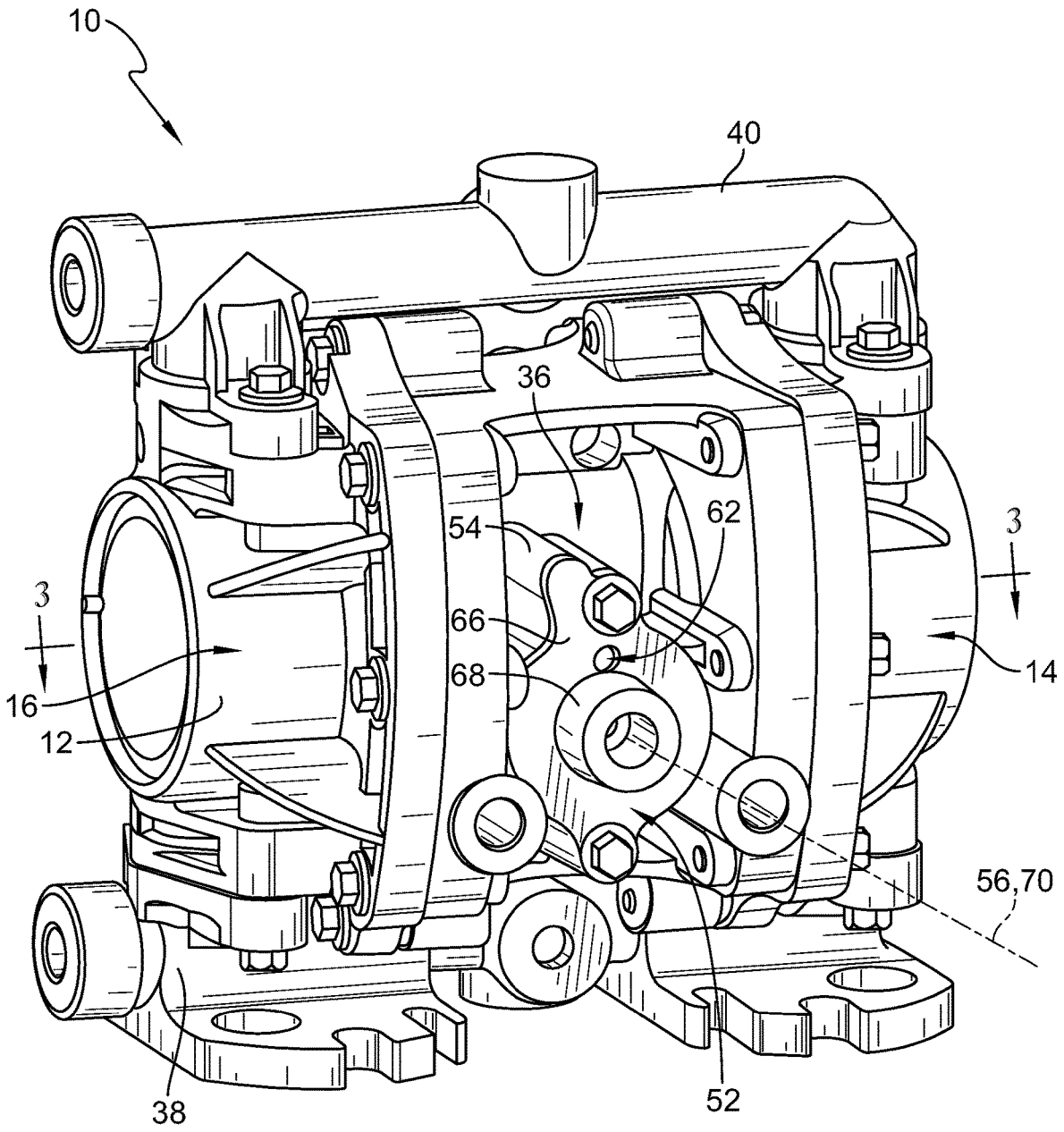
FIG. 2 is a rear perspective view of the pump of FIG. 1.
Figure 3:
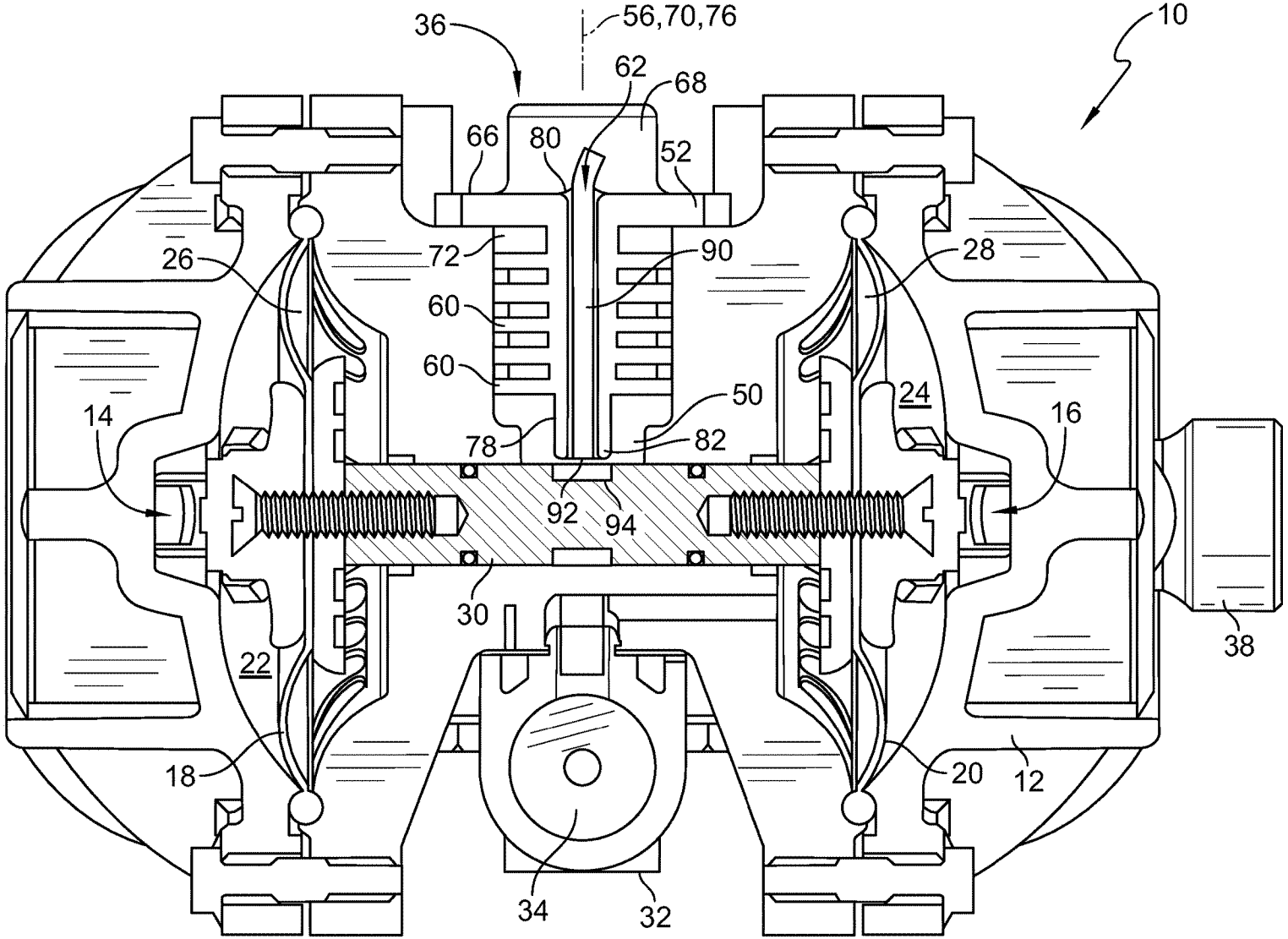
FIG. 3 is a cross-sectional view of the pump of FIGS. 1 and 2, taken along the line 3-3 in FIGS. 1 and 2.

Referring now to FIGS. 1-3, a diaphragm pump 10 is shown. The pump 10 of FIG. 1-3 is illustratively embodied as a double-diaphragm pump. It is contemplated that, in other embodiments, the pump 10 may be embodied as any other type of diaphragm pump. In the illustrative embodiment, the pump 10 has a housing 12 that defines a first working chamber 14 and a second working chamber 16. In the illustrative embodiment, the housing 12 is comprised of three sections coupled together by fasteners. As best seen in FIG. 3, the first and second working chambers 14, 16 of the pump 10 are each divided with respective first and second flexible diaphragms 18, 20 into respective first and second pump chambers 22, 24 and first and second motive fluid chambers 26, 28. The diaphragms 18, 20 are interconnected by a shaft 30, such that when the diaphragm 18 is moved to increase the volume of the associated pump chamber 22, the other diaphragm 20 is simultaneously moved to decrease the volume of the associated pump chamber 24, and vice versa.

The shaft 30 illustrated in FIG. 3 is a reciprocating diaphragm rod having a fixed length, such that the position of the shaft 30 in the pump 10 is indicative of the position of the diaphragms 18, 20. The shaft 30 and diaphragms 18, 20 move back and forth a fixed distance that defines a stroke. The fixed distance is determined by the geometry of the pump 10, the shaft 30, the diaphragms 18, 20, and other components of the pump 10 (e.g., the diaphragm washers). A stroke is defined as the travel path of the shaft 30 between first and second end of stroke positions. Movement of the shaft 30 from one end of stroke position to the other end of stroke position and back defines a cycle of operation of the shaft 30 (i.e., a cycle includes two consecutive strokes).

The pump 10 includes an inlet 32 for the supply of a motive fluid (e.g., compressed air, or another pressurized gas) and a valve 34 for alternately supplying the motive fluid to the first and second motive fluid chambers 26, 28 to drive reciprocation of the diaphragms 18, 20 and the shaft 30. When the valve 34 supplies motive fluid to the motive fluid chamber 26, the valve 34 places an exhaust assembly 36 in communication with the other motive fluid chamber 28 to permit motive fluid to be expelled therefrom. Conversely, when the valve 34 supplies motive fluid to the motive fluid chamber 28, the valve 34 places the motive fluid chamber 26 in communication with the exhaust assembly 36.

During operation of the pump 10, as the shaft 30 and the diaphragms 18, 20 reciprocate, the first and second pump chambers 22, 24 alternately expand and contract to create respective low and high pressure within the respective first and second pump chambers 22, 24. The pump chambers 22, 24 each communicate with an inlet manifold 38 that may be connected to a source fluid to be pumped and also each communicate with an outlet manifold 40 that may be connected to a receptacle for the fluid being pumped. Check valves (not shown) ensure that the fluid being pumped moves only from the inlet manifold 38 toward the outlet manifold 40. For instance, when the pump chamber 22 expands, the resulting negative pressure draws fluid from the inlet manifold 38 into the pump chamber 22. Simultaneously, the other pump chamber 24 contracts, which creates positive pressure to force fluid contained therein into the outlet manifold 40. Subsequently, as the shaft 30 and the diaphragms 18, 20 move in the opposite direction, the pump chamber 22 will contract and the pump chamber 24 will expand (forcing fluid contained in the pump chamber 24 into the outlet manifold 40 and drawing fluid from the inlet manifold 38 into the pump chamber 24).

Figure 4:
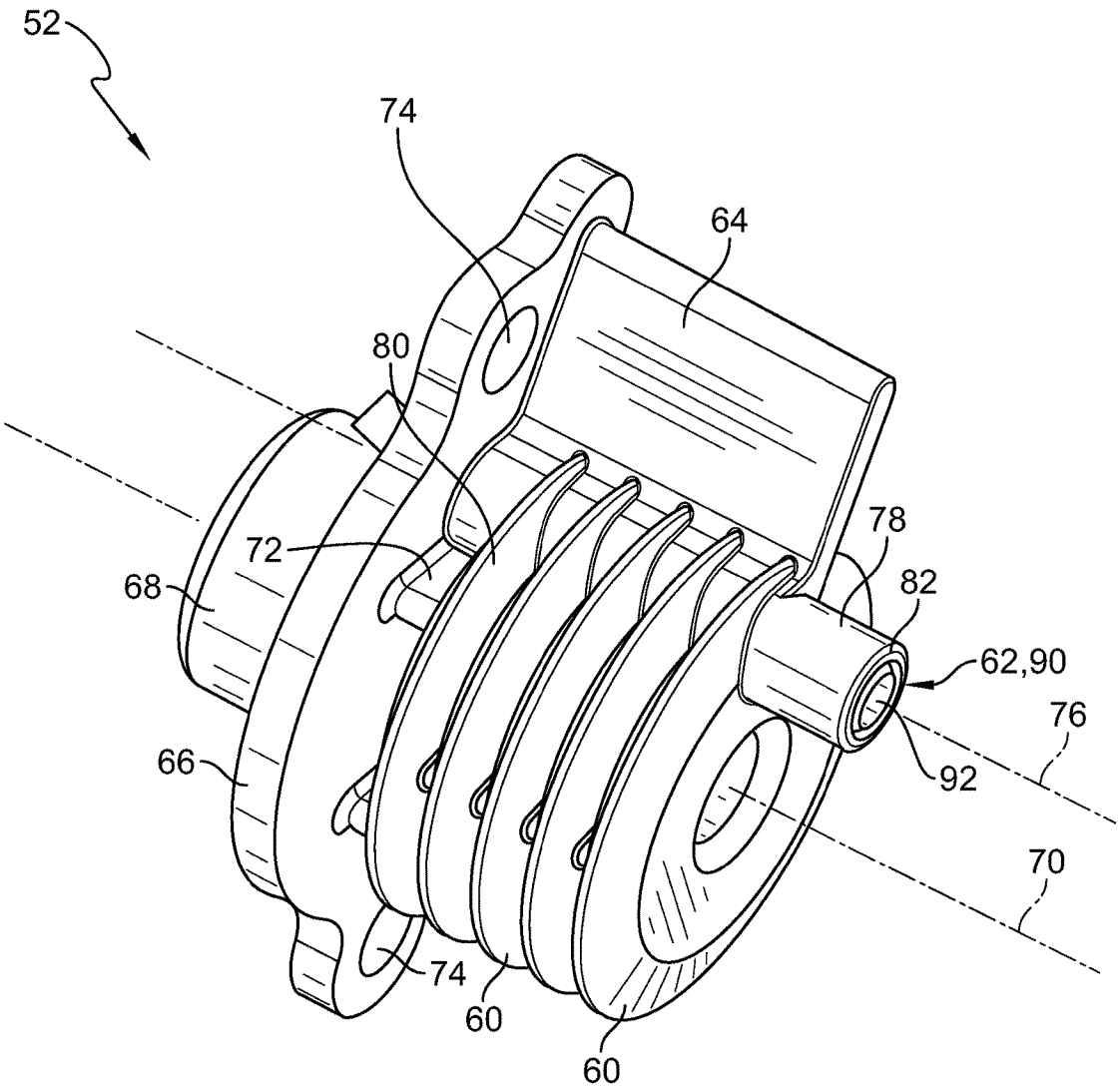
FIG. 4 is a perspective view of a muffler and a proximity sensor of the pump of FIGS. 1-3.

With reference to FIGS. 3 and 4, the exhaust assembly 36 includes an exhaust chamber 50 and a muffler 52. Except as noted below, the exhaust assembly 36 may have a design similar to the exhaust system described in U.S. Pat. No. 7,631,725 to Towne et al., the entire disclosure of which is incorporated by reference herein. In the illustrative embodiment, the exhaust chamber 50 has a generally cylindrical shape but also includes a longitudinal key slot 54 extending radially from a longitudinal axis 56 of the exhaust chamber 50. It is contemplated that the exhaust chamber 50 may be formed with various other geometries, and the generally cylindrical shape of the illustrative embodiment should not be regarded as limiting. The exhaust chamber 50 may be integrally cast with a section of the housing 12 in some embodiments, or may be separately fabricated and mounted to the housing 12 in other embodiments.

As best seen in FIG. 4, the muffler 52 includes a plurality of fins 60, a sensor mounting chamber 62, a longitudinal key 64, a flange 66, a collar 68, and a resonator stem (not shown). In the illustrative embodiments, the muffler 52 is integrally formed as one part by a process such as casting and is constructed of a substantially rigid plastic such as polypropylene. It is contemplated that, in other embodiments, the muffler 52 may be formed of another rigid material (e.g., aluminum, steel, cast iron, etc.) and may be formed by any suitable process. The fins 60 each extend radially outward from a longitudinal axis 70 of the muffler 52 (the longitudinal axis 70 being collinear with the longitudinal axis 56 of the exhaust chamber 50 when the exhaust assembly 36 is assembled). The longitudinal key 64 extends radially from the longitudinal axis 70 of the muffler 52 and across the distal ends of the fins 60. The flange 66 of the muffler 52, which is spaced from the last fin 60 by spacers 72 and by the key 64, includes a number of fastener holes 74. When the key 64 of the muffler 52 is received within the key slot 54 of the exhaust chamber 50, the fastener holes 74 of the flange 66 align with fastener holes surrounding the exhaust chamber 50 (e.g., in the housing 12) to facilitate mounting the muffler 52 to the exhaust chamber 50. Use of the key 64 and the key slot 54 ensures that the muffler 52 can only be installed within the exhaust chamber 50 in a particular orientation when the exhaust assembly 36 is assembled. In some embodiments, the collar 68 of the muffler 52 may include threading on its interior surface to facilitate connection of a conduit for receiving the exhausted motive fluid.

The sensor mounting chamber 62 of the muffler 52 extends along a longitudinal axis 76 that is parallel to, but spaced apart from, the longitudinal axis 70 of the muffler 52. As such, when the muffler 52 is installed in the exhaust chamber 50, the longitudinal axis 76 will also be parallel to and spaced apart from the longitudinal axis 56 of the exhaust chamber 50. In the illustrative embodiment, the sensor mounting chamber 62 is partially bounded by a generally cylindrical wall 78 that passes through each of the fins 60. As shown in FIG. 4, a first end 80 of the wall 78 (and, hence, the sensor mounting chamber 62) abuts the flange 66 of the muffler 52, while a second end 82 of the wall 78 (and, hence, the sensor mounting chamber 62) extends beyond the first fin 60.

Figure 5:
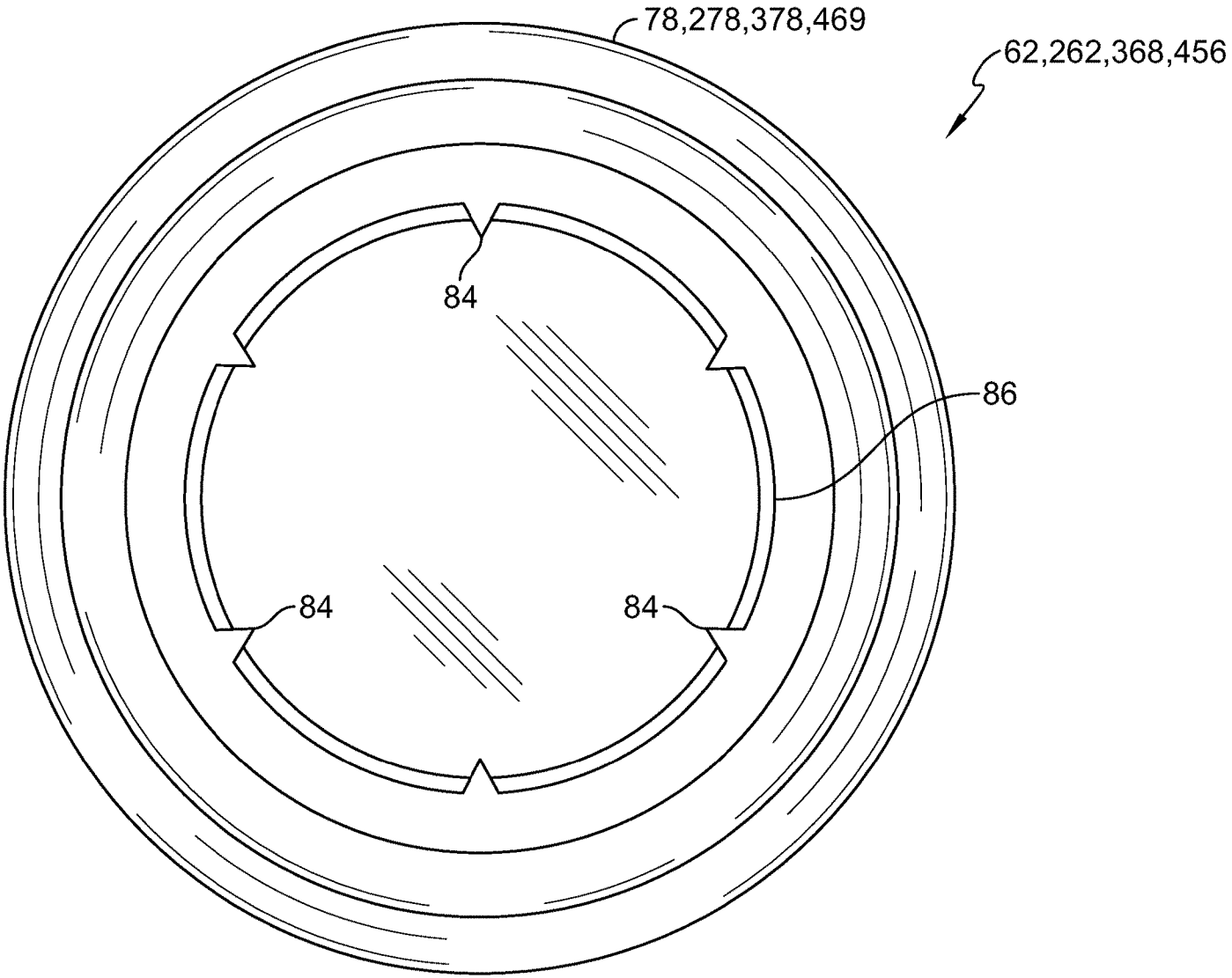
FIG. 5 is an end view of a sensor mounting chamber of the muffler of FIG. 4 (without the sensor mounted therein)

A view of the sensor mounting chamber 62 from the second end 82 is shown in FIG. 5 (without a sensor mounted therein). The sensor mounting chamber 62 has a generally circular cross-section bounded by the wall 78. In the illustrative embodiment, a number of protrusions 84 are formed on an inner surface 86 of the wall 78 and extend inwardly into the sensor mounting chamber 62. As shown in FIG. 5, the protrusions 84 each have a generally triangular shape, although it is contemplated that protrusions 84 of other shapes may be used in other embodiments. When included on the inner surface 86 of the wall 78, the protrusions 84 may assist in securing a sensor within the sensor mounting chamber 62.

As shown in FIGS. 3 and 4, a proximity sensor 90 is disposed within the sensor mounting chamber 62 of the muffler 52, such that a sensing end 92 of the proximity sensor 90 is flush with the second end 82 of sensor mounting chamber 62 (i.e., flush with the second end 82 of the wall 78). The proximity sensor 90 may be embodied as any type of device suitable for sensing the presence or absence of material (or a particular type of material) within a certain distance of the sensing end 92 of the device. In the illustrative embodiment, the proximity sensor 90 is embodied as an inductive proximity sensor 90 that detects the presence or absence of metallic material within a certain distance of its sensing end 92 (i.e., within its sensing field). One example of a suitable inductive proximity sensor 90 is part number PD1-AP-3A available from Automation Direct of Cumming, Ga. The proximity sensor 90 may have a generally cylindrical shape that corresponds to the generally cylindrical shape of the sensor mounting chamber 62. In the illustrative embodiment, the triangular protrusions 84 formed on the inner surface 86 of the wall 78 will form an interference fit with a threading on an exterior surface of the proximity sensor 90 to secure the proximity sensor 90 within the sensor mounting chamber 62 (and to maintain the sensing end 92 of the proximity sensor 90 flush with the second end 82 of the sensor mounting chamber 62).

When the muffler 52 is installed in the exhaust chamber 50, as illustrated in FIG. 3, the proximity sensor 90 disposed in the sensor mounting chamber 62 of the muffler 52 will be positioned a predetermined distance from the shaft 30 of the pump 10. Because the sensing end 92 of the proximity sensor 90 is flush with the second end 82 of the sensor mounting chamber 62 of the muffler 52, the predetermined distance between the sensing end 92 of the proximity sensor 90 and the shaft 30 of the pump 10 will be known to a high degree of precision. In addition, because the muffler 52 can only be installed within the exhaust chamber 50 in a particular orientation (due to the key 64 and the key slot 54), the proximity sensor 90 will be centered relative to the shaft 30 with a high degree of precision. This precise positioning of the proximity sensor 90 relative to the shaft 30 of the pump 10 increases the ability of the proximity sensor 90 to accurately detect the position and/or movement of the shaft 30.

The shaft 30 may include one or more features that are detectable by the proximity sensor 90 when the shaft 30 reciprocates between the first and second end of stroke positions. In the illustrative embodiment shown in FIG. 3, the shaft 30 is formed entirely of a metallic material but includes a central notch 94 where the shaft 30 has a smaller diameter. In this embodiment, the proximity sensor 90 will not be triggered when the shaft 30 is in a centered position within the pump 10 (i.e., the position shown in FIG. 3), as no metallic material is present within the sensing field of the proximity sensor 90. As the shaft 30 moves toward one of the end of stroke positions, the metallic material of a larger diameter portion of the shaft 30 will enter the sensing field of the proximity sensor 90 and trigger the proximity sensor 90. Other possible configurations for the shaft 30 that may be sensed by an inductive proximity sensor 90 are described in U.S. Patent Application Publication No. 2010/0196168 to Kozumplik et al., the entire disclosure of which is incorporated by reference herein.

Figure 6:
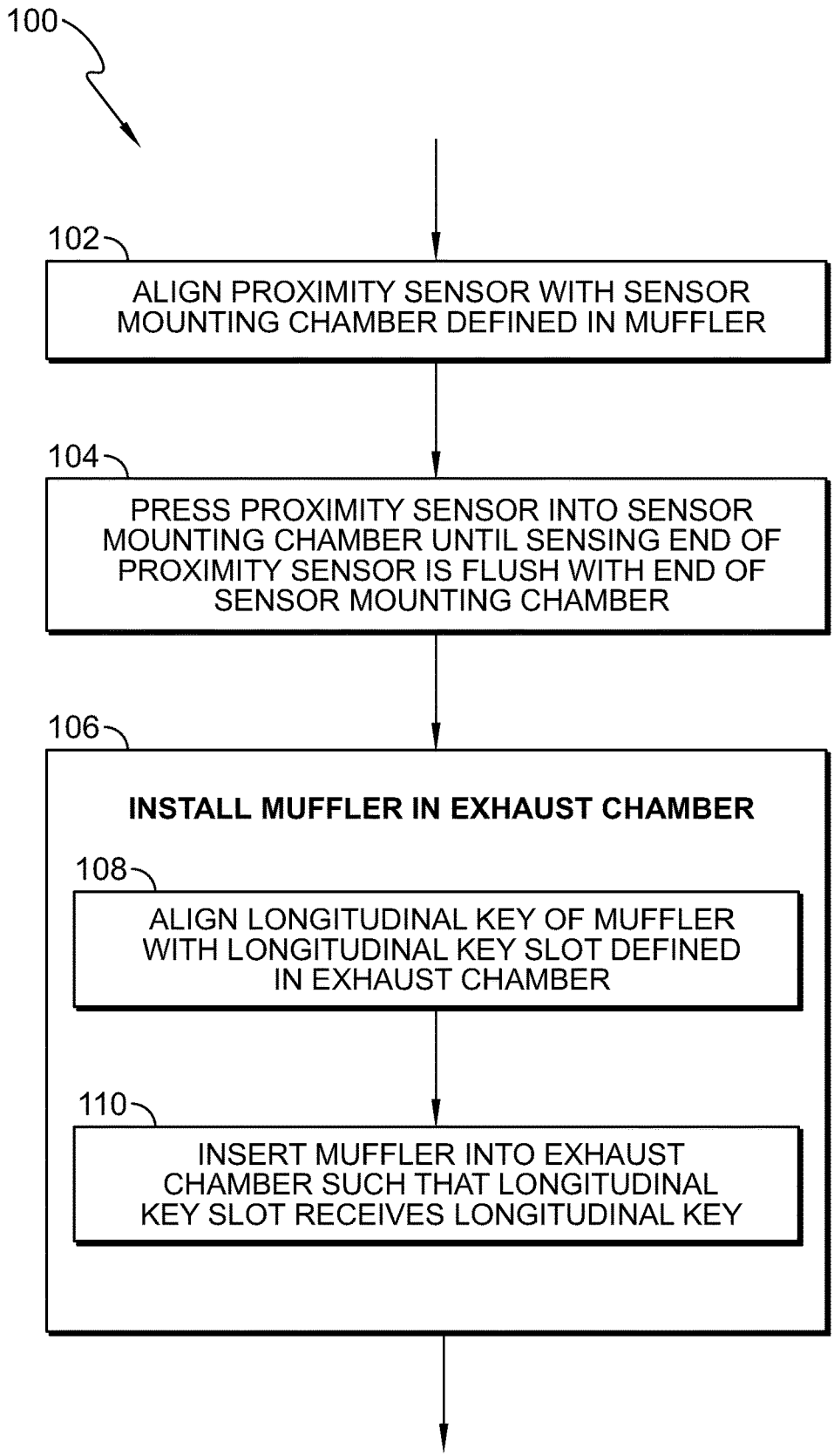
FIG. 6 is a simplified flowchart illustrating at least one embodiment of a method of mounting the proximity sensor in the pump of FIGS. 1-3.

Referring now to FIG. 6, one illustrative embodiment of a method 100 of mounting the proximity sensor 90 in the pump 10 is shown as a simplified flow diagram. For instance, the method 100 may be performed when newly assembling a pump 10 or when adding a proximity sensor 90 to an otherwise already assembled pump 10. The method 100 is illustrated as a number of blocks 102-110 in FIG. 6. It is contemplated that, in various embodiments of the method 100, each of the blocks 102-110 may be performed manually, with machine assistance, automatically by a machine, or any combination thereof.

The method 100 begins with block 102 in which the proximity sensor 90 is aligned with the sensor mounting chamber 62 defined in the muffler 52 of the pump 10. Block 102 may involve aligning the proximity sensor 90 with the longitudinal axis 76 of the sensor mounting chamber 62. In the illustrative embodiment, where the proximity sensor 90 and the sensor mounting chamber 62 are cylindrically shaped, block 102 may involve aligning an exterior surface of the proximity sensor 90 with the cylindrical wall 78 of the muffler 52. It will be appreciated that, in embodiments of the method 100 where the proximity sensor 90 is to be added to an otherwise already assembled pump 10, the muffler 52 may need to be removed from the pump 10 before block 102 is performed. This may be accomplished by removing the fasteners secured in the fastener holes 74 of the flange 66 of the muffler 52.

After block 102, the method 100 proceeds to block 104 in which the proximity sensor 90 is pressed into the sensor mounting chamber 62 until the sensing end 92 of the proximity sensor 90 is flush with the second end 82 of the sensor mounting chamber 62. As the proximity sensor 90 is inserted into the sensor mounting chamber 62, the second end 82 of the wall 78 will provide a stop for a tool being used to press the proximity sensor 90 into the sensor mounting chamber 62. Where the method 100 is performed with embodiments of the muffler 52 including the protrusions 84 extending into the sensor mounting chamber 62, block 104 may result in the protrusions 84 forming an interference fit with a threading on an exterior surface of the proximity sensor 90.

After block 104, the method 100 proceeds to block 106 in which the muffler 52 is installed in the exhaust chamber 50 of the pump 10. As described above, installation of the muffler 52 in the exhaust chamber 50 results in the sensing end 92 of the proximity sensor 90 being positioned a predetermined distance from the shaft 30 of the pump 10. In the illustrative embodiments, installation of the muffler 52 in the exhaust chamber 50 in block 106 also results in the proximity sensor 90 being centered along a stroke of the shaft 30. In some embodiments of the method 100, installing the muffler 52 in block 106 may involve performance of blocks 108 and 110. In such embodiments, block 106 includes block 108 in which the longitudinal key 64 of the muffler 52 is aligned with the longitudinal key slot 54 defined in the exhaust chamber 50. After block 108, the method 100 proceeds to block 110 in which the muffler 52 is inserted into the exhaust chamber 50 such that the longitudinal key slot 54 receives the longitudinal key 64. As described above, use of the key slot 54 and the key 64 ensures that the muffler 52 can only be installed within the exhaust chamber 50 in a particular orientation, so that the proximity sensor 90 will be centered relative to the shaft 30.

As will be appreciated from the above description, the muffler 52 thus serves as a means for mounting the proximity sensor 90 to the pump housing 12 such that the sensing end 92 is positioned at a predetermined distance from the shaft 30. In this illustrative embodiment, no additional mechanical calibration of the position of the sensor end 92 relative to the shaft 30 is required beyond the actions described above.

Figure 7:
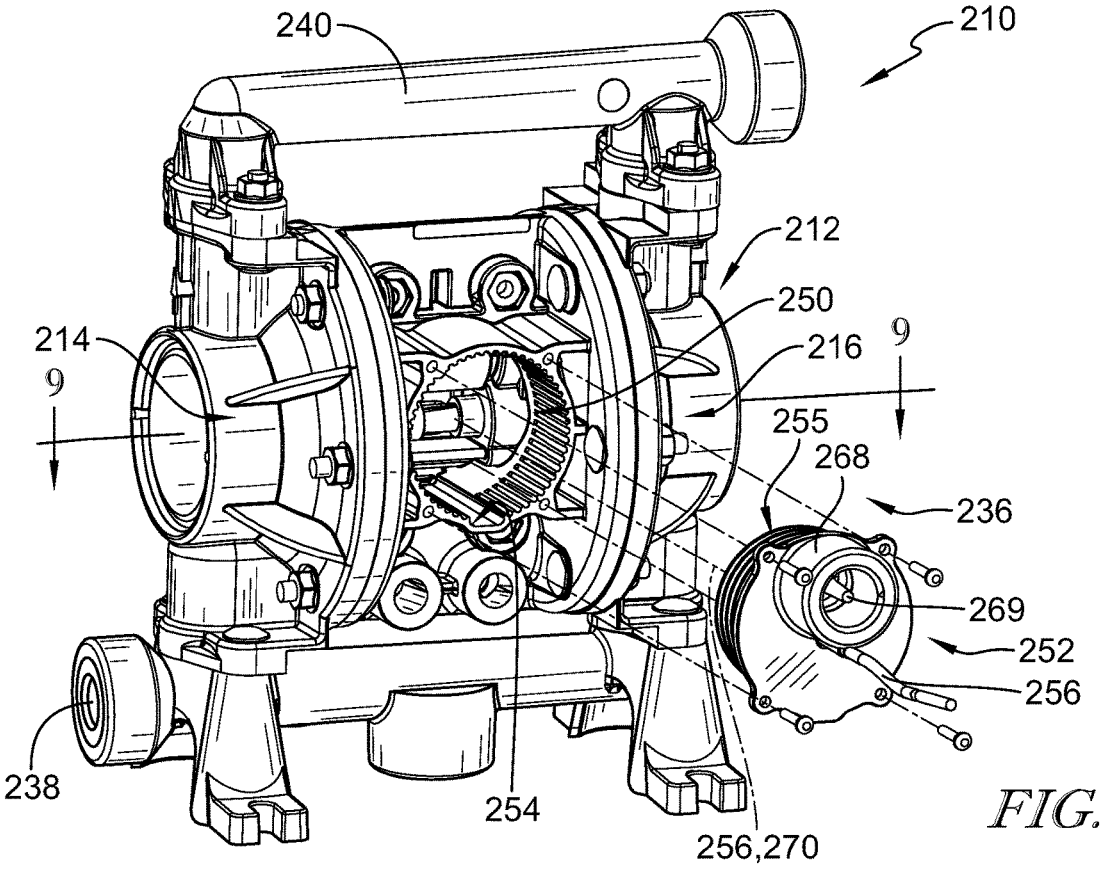
FIG. 7 is a rear perspective partially-exploded view of at least one other embodiment of a double diaphragm pump.
Figure 8:
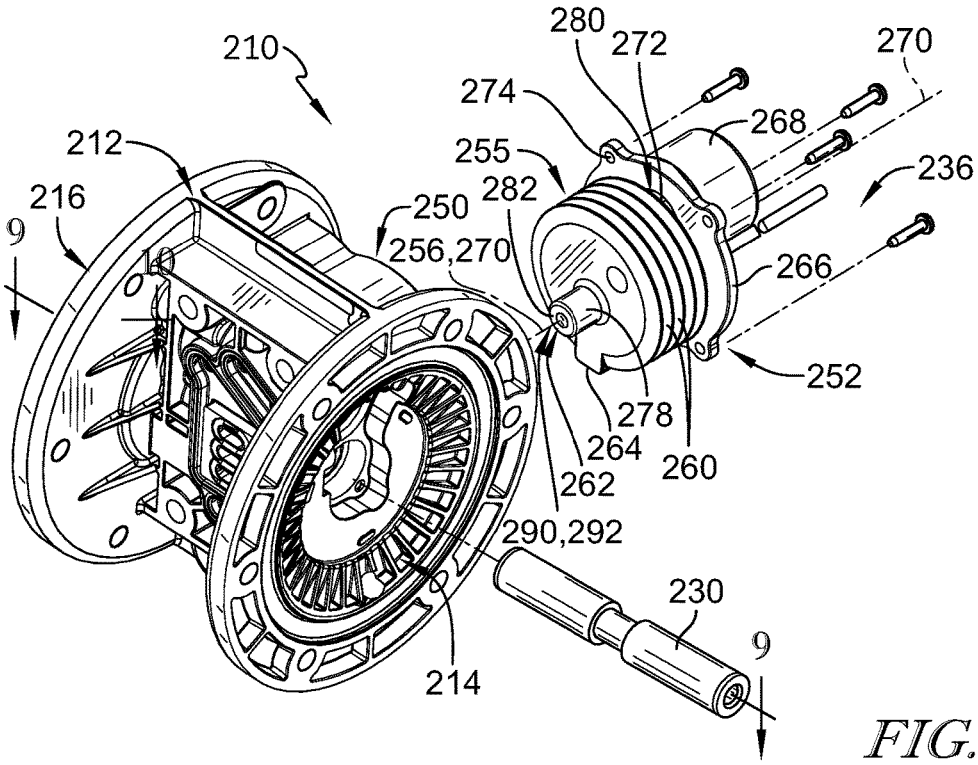
FIG. 8 is a front perspective partially-exploded view of portions of the pump of FIG. 7.
Figure 9:
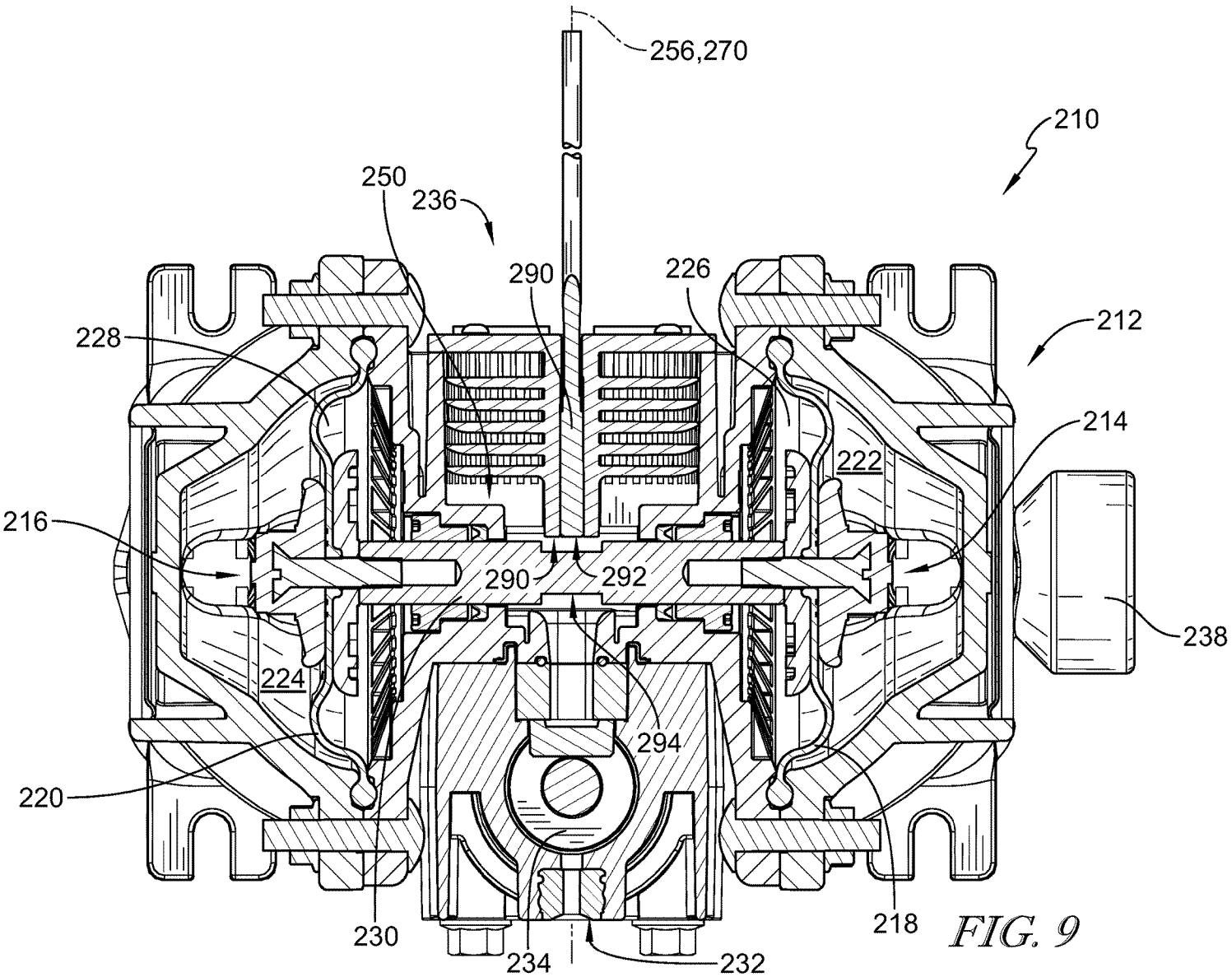
FIG. 9 is a cross-sectional view of the pump of FIGS. 7 and 8, taken along the line 9-9 in FIGS. 7 and 8.

Referring now to FIGS. 7-9, another illustrative embodiment of a diaphragm pump 210 is shown. The pump 210 of FIGS. 7-9 is illustratively embodied as a double-diaphragm pump. It is contemplated that, in some embodiments, the pump 210 may be embodied as any other type of diaphragm pump. In the illustrative embodiment, the pump 210 has a housing 212 that defines a first working chamber 214 and a second working chamber 216. In the illustrative embodiment, the housing 212 is comprised of three sections coupled together by fasteners. As best seen in FIG. 9, the first and second working chambers 214, 216 of the pump 210 are each divided with respective first and second flexible diaphragms 218, 220 into respective first and second pump chambers 222, 224 and first and second motive fluid chambers 226, 228. The diaphragms 218, 220 are interconnected by a shaft 230, such that when the diaphragm 218 is moved to increase the volume of the associated pump chamber 222, the other diaphragm 220 is simultaneously moved to decrease the volume of the associated pump chamber 224, and vice versa.

The shaft 230 illustrated in FIG. 9 is a reciprocating diaphragm rod having a fixed length, such that the position of the shaft 230 in the pump 210 is indicative of the position of the diaphragms 218, 220. The shaft 230 and diaphragms 218, 220 move back and forth a fixed distance that defines a stroke. The fixed distance is determined by the geometry of the pump 210, the shaft 230, the diaphragms 218, 220, and other components of the pump 210 (e.g., the diaphragm washers). A stroke is defined as the travel path of the shaft 30 between first and second end of stroke positions. Movement of the shaft 230 from one end of stroke position to the other end of stroke position and back defines a cycle of operation of the shaft 230 (i.e., a cycle includes two consecutive strokes).

The pump 210 includes an inlet 232 for the supply of a motive fluid (e.g., compressed air, or another pressurized gas) and a valve 234 for alternately supplying the motive fluid to the first and second motive fluid chambers 226, 228 to drive reciprocation of the diaphragms 218, 220 and the shaft 230. When the valve 234 supplies motive fluid to the motive fluid chamber 226, the valve 234 places an exhaust assembly 236 in communication with the other motive fluid chamber 228 to permit motive fluid to be expelled therefrom. Conversely, when the valve 234 supplies motive fluid to the motive fluid chamber 228, the valve 234 places the motive fluid chamber 226 in communication with the exhaust assembly 236.

During operation of the pump 210, as the shaft 230 and the diaphragms 218, 220 reciprocate, the first and second pump chambers 222, 224 alternately expand and contract to create respective low and high pressure within the respective first and second pump chambers 222, 224. The pump chambers 222, 224 each communicate with an inlet manifold 238 that may be connected to a source fluid to be pumped and also each communicate with an outlet manifold 240 that may be connected to a receptacle for the fluid being pumped. Check valves (not shown) ensure that the fluid being pumped moves only from the inlet manifold 238 toward the outlet manifold 240. For instance, when the pump chamber 222 expands, the resulting negative pressure draws fluid from the inlet manifold 238 into the pump chamber 222. Simultaneously, the other pump chamber 224 contracts, which creates positive pressure to force fluid contained therein into the outlet manifold 240. Subsequently, as the shaft 230 and the diaphragms 218, 220 move in the opposite direction, the pump chamber 222 will contract and the pump chamber 224 will expand (forcing fluid contained in the pump chamber 224 into the outlet manifold 240 and drawing fluid from the inlet manifold 238 into the pump chamber 224).

With reference to FIGS. 7 and 8, the exhaust assembly 236 includes an exhaust chamber 250 and a mount 252 having a muffler 255. Except as noted below, the exhaust assembly 236 may have a design similar to the exhaust system described in U.S. Pat. No. 7,631,725 to Towne et al., the entire disclosure of which is incorporated by reference herein. In the illustrative embodiment, the exhaust chamber 250 has a generally cylindrical shape but also includes a longitudinal key slot 254 extending radially from a longitudinal axis 256 of the exhaust chamber 250. It is contemplated that the exhaust chamber 250 may be formed with various other geometries, and the generally cylindrical shape of the illustrative embodiment should not be regarded as limiting. The exhaust chamber 250 may be integrally cast with a section of the housing 212 in some embodiments, or may be separately fabricated and mounted to the housing 212 in other embodiments.

As best seen in FIG. 8, the mount 252 includes the muffler 255 comprising a plurality of fins 260, a sensor mounting chamber 262, a longitudinal key 264, a flange 266, a collar 268, and a resonator stem 269. In the illustrative embodiments, the mount 252 is integrally formed as one part by a process such as casting and is constructed of a substantially rigid plastic such as polypropylene. It is contemplated that, in other embodiments, the mount 252 may be formed of another rigid material (e.g., aluminum, steel, cast iron, etc.) and may be formed by any suitable process. The fins 260 of muffler 255 each extend radially outward from a longitudinal axis 270 of the mount 252 (the longitudinal axis 270 being collinear with the longitudinal axis 256 of the exhaust chamber 250 when the exhaust assembly 236 is assembled). The longitudinal key 264 extends radially from the longitudinal axis 270 of the mount 252 and across the distal ends of the fins 260. The flange 266 of the mount 252, which is spaced from the last fin 260 of the muffler 255 by spacers 272 and by the key 264, includes a number of fastener holes 274. When the key 264 of the mount 252 is received within the key slot 254 of the exhaust chamber 250, the fastener holes 274 of the flange 266 align with fastener holes surrounding the exhaust chamber 250 (e.g., in the housing 212) to facilitate attaching the mount 252 to the housing 212. Use of the key 264 and the key slot 254 ensures that the mount 252 can only be installed onto the housing 212 such that the muffler 255 is located within the exhaust chamber 250 in a particular orientation when the exhaust assembly 236 is assembled. In some embodiments, the collar 268 of the mount 252 may include threading on its interior surface to facilitate connection of a conduit for receiving the exhausted motive fluid.

The sensor mounting chamber 262 of the mount 252 extends along the longitudinal axis 270 of the mount 252. As noted above, when the mount 252 is installed such that the muffler 255 is within the exhaust chamber 250, the longitudinal axis 270 will be collinear with the longitudinal axis 256 of the exhaust chamber 250. In the illustrative embodiment, the sensor mounting chamber 262 is partially bounded by a generally cylindrical wall 278 that passes through each of the fins 260. As suggested in FIG. 8, a first end 280 of the wall 278 (and, hence, the sensor mounting chamber 262) abuts the flange 266 of the mount 252, while a second end 282 of the wall 278 (and, hence, the sensor mounting chamber 262) extends beyond the first fin 260.

The sensor mounting chamber 262 is illustratively formed with a similar configuration to the sensor mounting chamber 62, as shown in FIG. 5 (shown without a sensor mounted therein). The sensor mounting chamber 262 has a generally circular cross-section bounded by the wall 278. In the illustrative embodiment, a number of protrusions 84 are formed on an inner surface 86 of the wall 278 and extend inwardly into the sensor mounting chamber 262. As shown in FIG. 5, the protrusions 84 each have a generally triangular shape, although it is contemplated that protrusions 84 of other shapes may be used in other embodiments. When included on the inner surface 86 of the wall 278, the protrusions 84 may assist in securing a sensor within the sensor mounting chamber 262.

As shown in FIGS. 8 and 9, a proximity sensor 290 is disposed within the sensor mounting chamber 262 of the mount 252, such that a sensing end 292 of the proximity sensor 290 is flush with the second end 282 of the sensor mounting chamber 262 (i.e., flush with the end 282 of the wall 278). The proximity sensor 290 may be embodied as any type of device suitable for sensing the presence or absence of material (or a particular type of material) within a certain distance of the sensing end 292 of the device. In the illustrative embodiment, the proximity sensor 290 is embodied as an inductive proximity sensor, similar to proximity sensor 90 of the pump 10, that detects the presence or absence of metallic material within a certain distance of its sensing end 292 (i.e., within its sensing field). The proximity sensor 290 may have a generally cylindrical shape that corresponds to the generally cylindrical shape of the sensor mounting chamber 262. In the illustrative embodiment, the triangular protrusions 84 formed on the inner surface 86 of the wall 278 will form an interference fit with a threading on an exterior surface of the proximity sensor 290 to secure the proximity sensor 290 within the sensor mounting chamber 262 (and to maintain the sensing end 292 of the proximity sensor 290 flush with the second end 282 of the sensor mounting chamber 262).

When the mount 252 is installed onto the housing 212 such that the exhaust chamber 250 is within the exhaust chamber 250, as illustrated in FIG. 9, the proximity sensor 290 disposed in the sensor mounting chamber 262 of the mount 252 will be positioned a predetermined distance from the shaft 230 of the pump 210. Because the sensing end 292 of the proximity sensor 290 is flush with the second end 282 of the sensor mounting chamber 262 of the mount 252, the predetermined distance between the sensing end 292 of the proximity sensor 290 and the shaft 230 of the pump 210 will be known to a high degree of precision. In addition, because the mount 252 can only be installed within the exhaust chamber 250 in a particular orientation (due to the key 264 and the key slot 254), the proximity sensor 290 will be centered relative to the shaft 230 with a high degree of precision. This precise positioning of the proximity sensor 290 relative to the shaft 230 of the pump 210 increases the ability of the proximity sensor 290 to accurately detect the position and/or movement of the shaft 230.

The shaft 230 may include one or more features that are detectable by the proximity sensor 290 when the shaft 230 reciprocates between the first and second end of stroke positions. In the illustrative embodiment shown in FIG. 9, the shaft 230 is formed entirely of a metallic material but includes a central notch 294 where the shaft 230 has a smaller diameter. In this embodiment, the proximity sensor 290 will not be triggered when the shaft 230 is in a centered position within the pump 210 (i.e., the position shown in FIG. 9), as no metallic material is present within the sensing field of the proximity sensor 290. As the shaft 230 moves toward one of the end of stroke positions, the metallic material of a larger diameter portion of the shaft 230 will enter the sensing field of the proximity sensor 290 and trigger the proximity sensor 290. Other possible configurations for the shaft 230 that may be sensed by an inductive proximity sensor 290 are described in U.S. Patent Application Publication No. 2010/0196168 to Kozumplik et al., the entire disclosure of which is incorporated by reference herein.

As will be appreciated from the above description, the mount 252 thus serves as a means for mounting the proximity sensor 290 to the pump housing 212 such that the sensing end 292 is positioned at a predetermined distance from the shaft 230. In this illustrative embodiment, no additional mechanical calibration of the position of the sensor end 292 relative to the shaft 230 is required beyond the actions described above.

Figure 10:
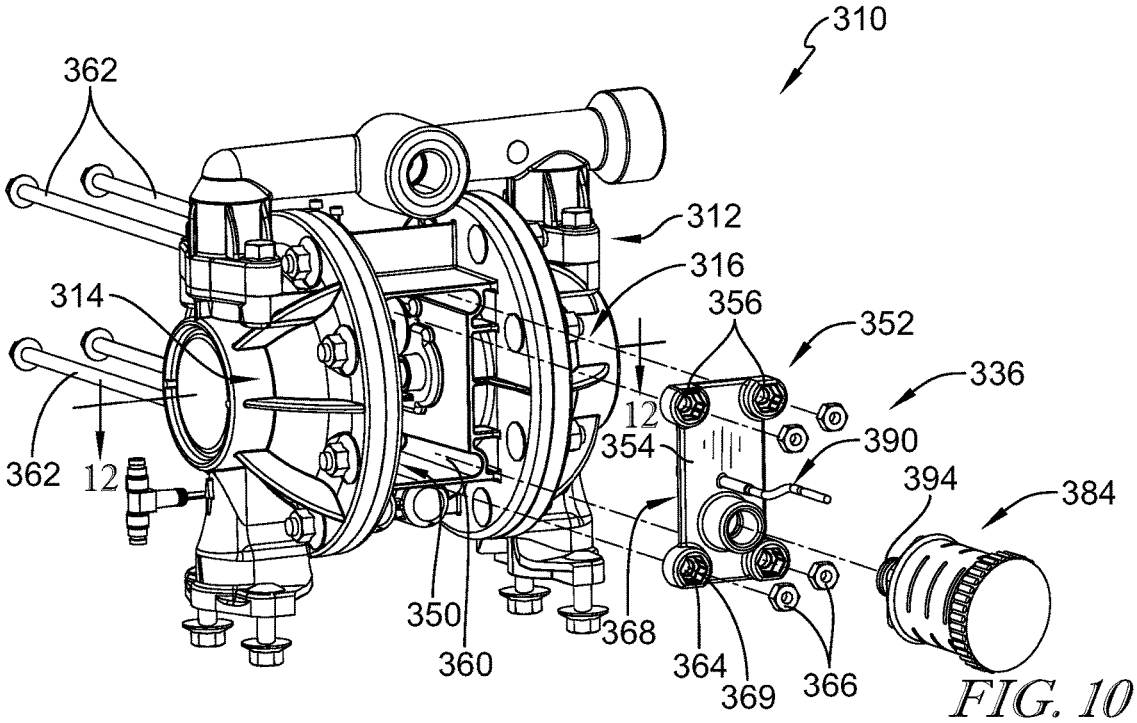
FIG. 10 is a rear perspective partially-exploded view of at least one other embodiment of a double diaphragm pump.
Figure 11:
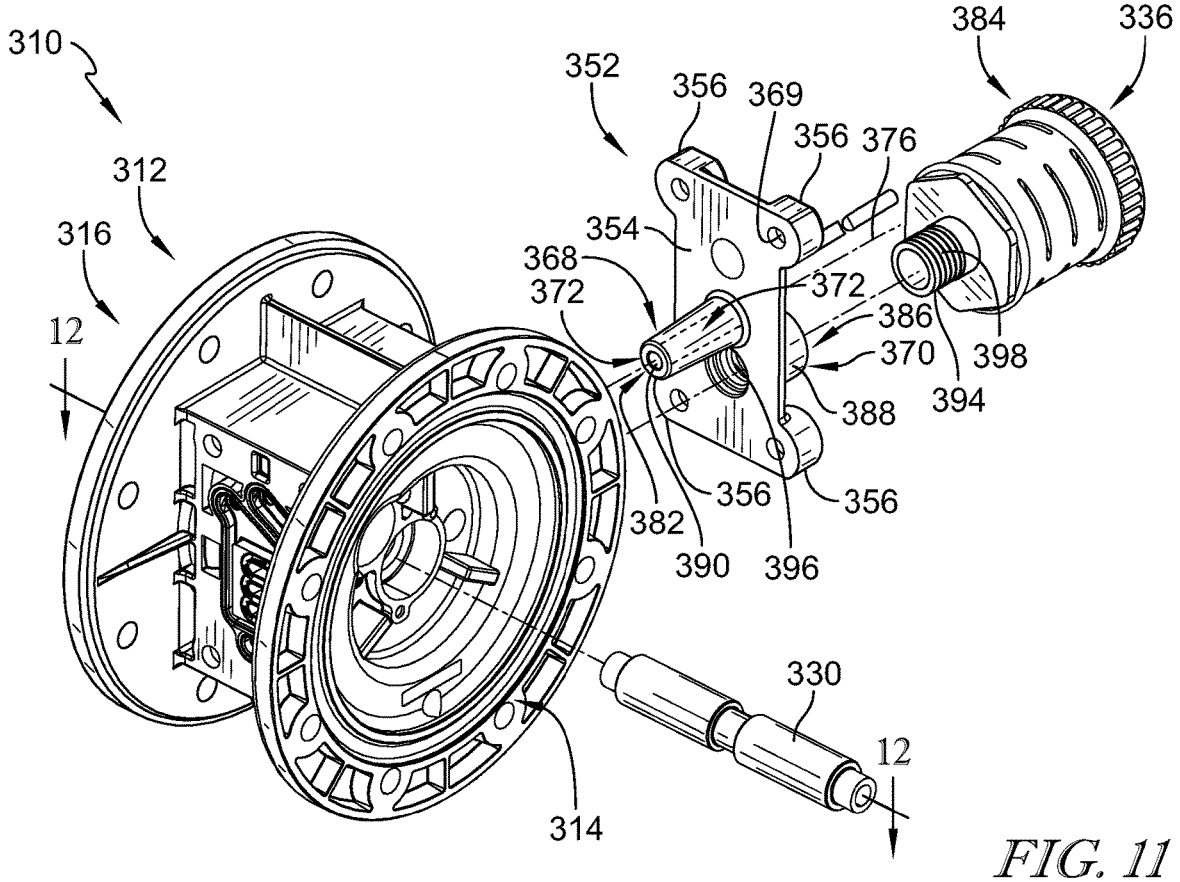
FIG. 11 is a front perspective partially-exploded view of portions of the pump of FIG. 10.
Figure 12:
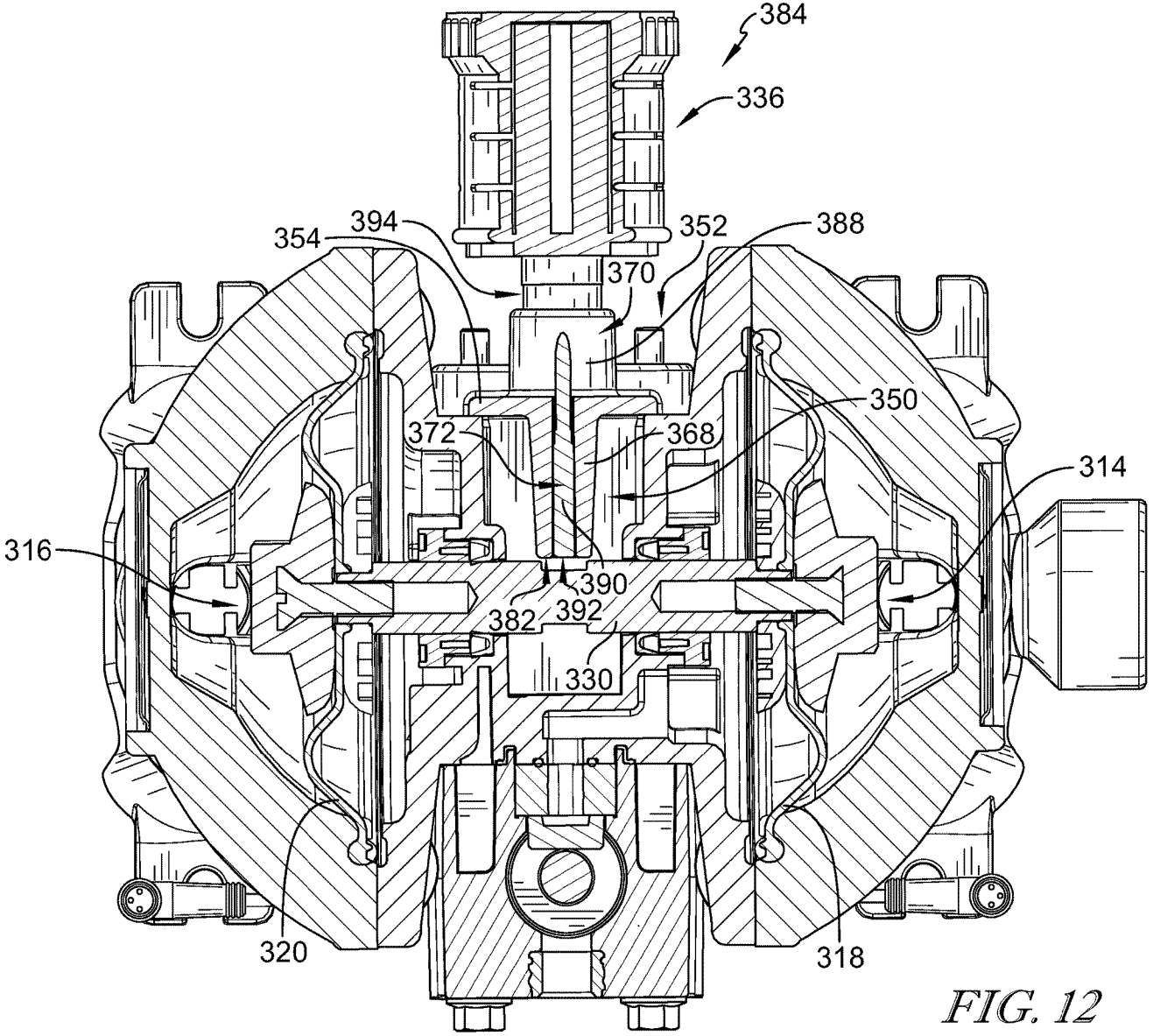
FIG. 12 is a cross-sectional view of the pump of FIGS. 10 and 11, taken along the line 12-12 in FIGS. 10 and 11.

Referring now to FIGS. 10-12, another illustrative embodiment of a diaphragm pump 310 is shown. The diaphragm pump 310 is generally embodied as having similar features and operation as those of the diaphragm pumps 10, 210, and the disclosure of each of the pumps 10, 210 is incorporated by reference to apply to the diaphragm pump 310, except as modified herein and in instances that would conflict with the disclosure of the diaphragm pump 310.

Referring to FIG. 10, the diaphragm pump 310 illustratively includes a housing 312 that defines a first working chamber 314 and a second working chamber 316 each respectively divided by a diaphragm 318, 320 (shown in FIG. 12). In the illustrative embodiment, the housing 312 is comprised of three sections coupled together by fasteners. Diaphragm pump 310 has an exhaust assembly 336 illustratively including an exhaust chamber 350 defined in the housing 312 and a mount 352 configured to removably attach to the housing 312.

The exhaust chamber 350 illustratively receives motive fluid from the working chambers 314, 316 that has driven reciprocal motion of a shaft 330 to pump source fluid from an inlet manifold 338 to an outlet manifold 340. The exhaust chamber 350 is generally I-shaped. Spaces 360 defined along corners of the exhaust chamber 350 are shaped to receive fasteners 362 through the housing 312 to attach the mount 352. The mount 352 illustratively attaches to the housing 312 to enclose the exhaust chamber 350.

As shown in FIGS. 10 and 11, the mount 352 is illustratively shaped complimentary to the exhaust chamber 350. The mount 352 illustratively includes a body plate 354 and a number of receivers 356 disposed at edges of the body plate 354, each receiver 356 being positioned to correspond with one of the spaces 360 of the exhaust chamber 350. Each receiver 356 illustratively defines a recess 364 shaped to receive a fastener nut 366, and a bore 369 extending through the receiver 356 to accept one of the fasteners 362 therethrough for connection with the fastener nut 366.

As best shown in FIG. 11, the mount 352 illustratively includes a sensor receptacle 368 and a muffler receptacle 370 each connected to the body plate 354. Sensor receptacle 368 illustratively extends from the body plate 354 in a first direction along an axis 376 towards the shaft 330 to an end 382. The muffler receptacle 370 illustratively extends from the body plate 354 in a second direction opposite to the first direction and spaced apart from the axis 376. In the illustrative embodiment, the sensor receptacle 368 extends from the body plate 354 spaced apart from the muffler receptacle 370 to define an offset.

As shown in FIG. 12, when the mount 352 is removably attached to the housing 312, the sensor receptacle 368 extends into the exhaust chamber 350 such that the end 382 of the sensor receptacle 368 is positioned at a predetermined distance from the shaft 330. The sensor receptacle 368 is configured to receive a proximity sensor 390 for mounting at the predetermined distance relative to the shaft 330. The proximity sensor 390 is illustratively embodied to be similar to the proximity sensors 90, 290 of the pumps 10, 210. The sensor receptacle 368 illustratively includes a sensor mount chamber 372 defined therein for receiving the sensor 390.

The sensor mount chamber 372 is illustratively embodied as a bore defined by an inner surface 86 of a wall 378 of the sensor receptacle 368 as shown in FIG. 5. The wall 378 illustratively includes protrusions 84 extending radially from the inner surface 86 for contact with an exterior surface of the proximity sensor 390 to secure the proximity sensor 390 within the sensor receptacle 368.

When the mount 352 is removably attached to the housing 312, the sensor receptacle 368 secures the sensor 390 in place and maintains a sensing end 392 of the proximity sensor 390 flush with the end 382 of the sensor receptacle 368 as shown in FIGS. 11 and 12. Because the sensing end 392 of the proximity sensor 390 is flush with the end 382 of the sensor receptacle 368 of the muffler 52, the predetermined distance between the sensing end 392 of the proximity sensor 390 and the shaft 330 of the pump 310 will be known to a high degree of precision. This precise positioning of the proximity sensor 390 relative to the shaft 330 of the pump 310 increases the ability of the proximity sensor 390 to accurately detect the position and/or movement of the shaft 330.

As best seen in FIG. 11, the muffler receptacle 370 illustratively receives a muffler 384 for fluid connection with the exhaust chamber 350. The muffler receptacle 370 illustratively includes a muffler mount chamber 386 defined through the muffler receptacle 370 by a wall 388 having an inner surface 396 that is shaped to receive an inlet 394 of the muffler 384 for fluid connection with the exhaust chamber 350. The inner surface 396 illustratively includes inner threads configured for engagement with outer threads 398 disposed on an outer surface of the inlet 394 for connection of the muffler 384 to the muffler receptacle 370. Motive fluid from exhaust chamber 350 is communicated through mount 352 via the muffler receptacle 370 and into the inlet 394 of the muffler 384.

It should be appreciated that the proximity sensor 390 can be secured within the sensor receptacle 368 (with the sensing end 392 flush with the end 382) while the mount 352 is not attached to the housing 312. The mount 352 can then be attached to the housing 312 with the sensor 390 secured within the sensor receptacle 368. The muffler 384 can be attached to the mount 352 with the mount 352 attached to the housing 312. As such, the sensor 390 can be positioned relative to the shaft 330 with a high degree of precision, while minimizing mechanical calibration. In this way, the mount 352 serves as a means for mounting the proximity sensor 390 to the pump housing 312 such that the sensing end 392 is positioned at a predetermined distance from the shaft 330. In this illustrative embodiment, no additional mechanical calibration of the position of the sensor end 392 relative to the shaft 330 is required beyond the actions described above.

Figure 13:
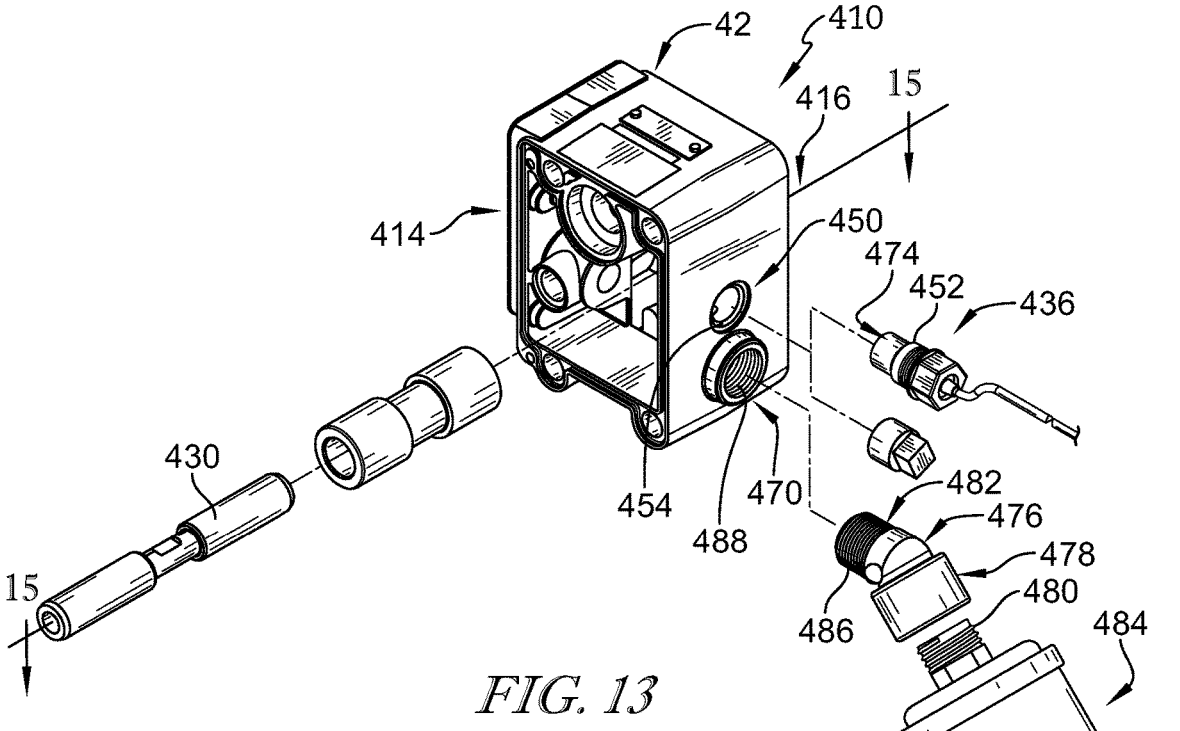
FIG. 13 is a rear perspective partially-exploded view of portions of at least one other embodiment of a double diaphragm pump.
Figure 14:
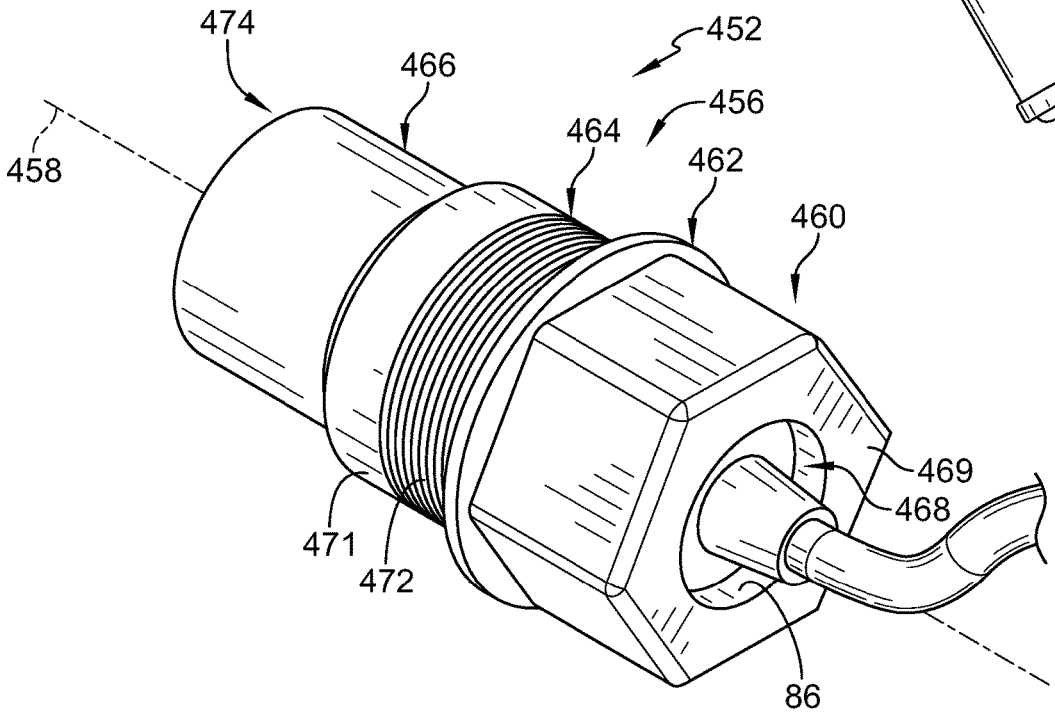
FIG. 14 is a rear perspective view of a mount of the double diaphragm pump of FIG. 13.
Figure 15:
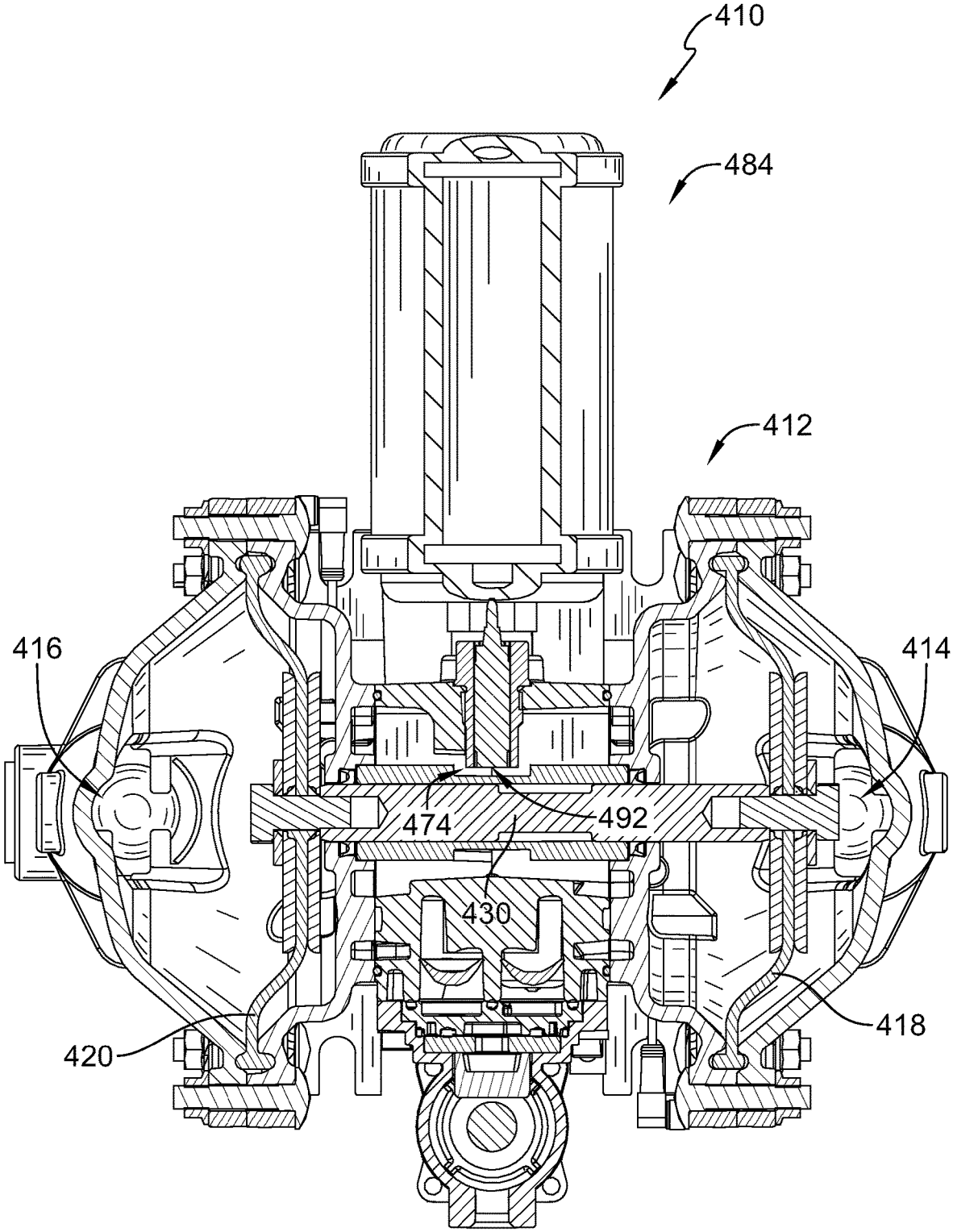
FIG. 15 is a cross-sectional view of the pump of FIG. 13, taken along the line 15-15 in FIG. 13.

Referring now to FIGS. 13-15, another illustrative embodiment of a diaphragm pump 410 is shown. The diaphragm pump 410 is generally embodied as having similar features and operation as those of the diaphragm pumps 10, 210, 310 and the disclosure of each of the pumps 10, 210, 310 is incorporated by reference to apply to the diaphragm pump 410, except as modified herein and in instances that would conflict with the disclosure of the diaphragm pump 410.

Referring to FIG. 13, diaphragm pump 410 illustratively includes a housing 412 (of which only a center section is shown in FIG. 13) that defines a first working chamber 414 and a second working chamber 416. In the illustrative embodiment, the housing 412 is comprised of three sections coupled together by fasteners (as shown in FIG. 15). Diaphragm pump 410 has an exhaust assembly 436 illustratively including an exhaust chamber 450 defined in the housing 412 and a mount 452 configured to attach to the housing 412.

The exhaust chamber 450 illustratively receives motive fluid from the working chambers 414, 416 that has driven reciprocal motion of a shaft 430 to pump source fluid from an inlet manifold 438 to an outlet manifold 440. The exhaust chamber 450 includes an opening 454 defined in a side of housing 412, the opening 454 being configured to receive the mount 452 for attachment thereto. The mount 352 illustratively attaches to the housing 412 to enclose the exhaust chamber 450 and to secure a proximity sensor 490 at a predetermined distance from the shaft 430.

As shown in FIG. 14, the mount 452 illustratively includes a sensor receptacle 456 extending along an axis 458 and including a head 460 having a base plate 462 at one end thereof, a mid-section 464 extending from the base plate 462, and a stem 466 extending from the mid-section 464. The head 460 illustratively extends from an opposite side of the base plate 462 along the axis 458 and illustratively has a hexagonal shape. The base plate 462 is illustratively positioned between the head 460 and the mid-section 464. Mid-section 464 extends from the base plate 462 away from the head 460 and includes an outer surface 471 having threads 472 disposed thereon for securing the mount 452 to the housing 412 within the exhaust chamber 450. The stem 466 illustratively extends from the mid-section 464 along the axis 458 away from the base plate 462. The sensor receptacle 456 includes an end 474 positioned away from the head 460.

As shown in FIG. 14, the sensor receptacle 456 illustratively includes a sensor mounting chamber 468 that includes a wall 469 and a bore extending through the sensor receptacle 456 from the head 460 to the end 474 along the axis 458. As shown in FIG. 5, an inner surface 86 of the wall 469 of the sensor mounting chamber 468 illustratively includes protrusions 84 extending radially therefrom. The protrusions 84 are illustratively arranged to engage threads of an outer surface of the proximity sensor 490 to secure the proximity sensor within the sensor mounting chamber 468 of the sensor receptacle 456 by interference fit. The proximity sensor 490 is illustratively embodied to be similar to the proximity sensors 90, 290, 390 of the pumps 10, 210, 310.

As best shown in FIG. 15, the proximity sensor 490 is illustratively secured within the sensor mounting chamber 468 of the sensor receptacle 456 such that a sensing end 492 of the proximity sensor 490 is flush with the end 474 of the sensor receptacle 456. When the mount 452 is attached to the housing 412, the sensor receptacle 456 extends into the exhaust chamber 450 and is positioned at a predetermined distance from the shaft 430. Because the sensing end 492 of the proximity sensor 490 is flush with the end 474 of the sensor receptacle 456, the predetermined distance between the sensing end 492 of the proximity sensor 490 and the shaft 430 of the pump 410 will be known to a high degree of precision. This precise positioning of the proximity sensor 490 relative to the shaft 430 increases the ability of the proximity sensor 490 to accurately detect the position and/or movement of the shaft 430.

It should be appreciated that the proximity sensor 390 can be secured within the sensor receptacle 456 by pressing the sensor 490 into the bore of the sensor receptacle 456 (such that the sensing end 492 of the sensor 490 is flush with the end 474 of the sensor receptacle 456) while the mount 452 is not attached to the housing 412. The mount 452 can then be attached to the housing 412 with the sensor 490 secured within the sensor receptacle 456. As such, the sensor 490 can be positioned relative to the shaft 430 with a high degree of precision, while minimizing mechanical calibration. In this way, the mount 452 serves as a means for mounting the proximity sensor 490 to the pump housing 412 such that the sensing end 492 is positioned at a predetermined distance from the shaft 430. In this illustrative embodiment, no additional mechanical calibration of the position of the sensor end 492 relative to the shaft 430 is required beyond the actions described above.

As best seen in FIG. 13, the housing 412 illustratively includes a muffler receptacle 470 for fluid connection of the exhaust chamber 450 to a muffler 484. The muffler receptacle 470 illustratively extends from the housing 412 spaced apart from the opening 454, and is configured to receive a muffler connector 476 having a muffler end 478 configured to fluidly connect with an inlet 480 of the muffler 484, and a housing end 482 configured to engage with housing 412. In the illustrative embodiment, the housing end 482 of the muffler connector 476 includes threads 486 on an exterior surface thereof for engagement with threads 488 on an interior surface of the muffler receptacle 470. The inlet 480 of muffler 484 is illustratively connected to the muffler end 478 of the muffler connector 476 by threaded engagement.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A diaphragm pump comprising:

a shaft disposed within a pump housing and coupled to at least one diaphragm;

a mount removably attached to the pump housing and having a sensor receptacle wherein a portion of the sensor receptacle extends from the mount toward the shaft; and a proximity sensor received in the sensor receptacle of the mount such that a sensing end of the proximity sensor is flush with an end of the sensor receptacle nearest the shaft, wherein the sensor receptacle comprises a receptacle housing and a bore defined through the receptacle housing for receiving the proximity sensor, and wherein the mount is positioned at an exhaust chamber of the pump housing and exhausted motive fluid exits the pump housing via the mount.

2. The diaphragm pump of claim 1, wherein the sensor receptacle comprises one or more protrusions extending inwardly into the bore from an inner surface of the receptacle housing, the one or more protrusions forming an interference fit with an exterior surface of the proximity sensor to secure the proximity sensor within the sensor receptacle.

3. The diaphragm pump of claim 1, wherein the exhaust chamber is configured to receive a motive fluid that has driven reciprocation of the at least one diaphragm and the shaft, and wherein the sensor receptacle of the mount extends into the exhaust chamber.

4. The diaphragm pump of claim 3, wherein the mount comprises a body plate, and the sensor receptacle extends from a side of the body plate.

5. The diaphragm pump of claim 4, wherein the mount includes a muffler receptacle, the muffler receptacle being configured to receive an inlet of an exhaust muffler for fluid connection of the exhaust muffler to the exhaust chamber.

6. The diaphragm pump of claim 5, wherein the muffler receptacle comprises a projection extending from the mount away from the shaft and a bore extending through the projection, the bore being configured to receive the inlet of the exhaust muffler.

7. The diaphragm pump of claim 5, wherein the sensor receptacle and the muffler receptacle extend from opposite sides of the body plate.

8. The diaphragm pump of claim 1, wherein the proximity sensor is retained within the sensor receptacle of the mount independently of the mount being removably attached to the pump housing.

9. A diaphragm pump comprising:

a shaft disposed within a pump housing and coupled to at least one diaphragm;

a proximity sensor for sensing a position of the shaft, the proximity sensor having a sensing end; and means for mounting the proximity sensor to the pump housing such that the sensing end is positioned at a predetermined distance from the shaft when the means is removably attached to the pump housing;

wherein the means comprises a sensor receptacle configured to receive the proximity sensor therein such that the sensing end of the proximity sensor is flush with an end of the sensor receptacle, and wherein the means for mounting further comprises an exit for exhausted motive fluid to be expelled from the pump housing.

10. The diaphragm pump of claim 9, wherein the proximity sensor is received in the sensor receptacle independently of the means being removably attached to the pump housing.

11. The diaphragm pump of claim 9, wherein the means for mounting further comprises a muffler.

12. A diaphragm pump comprising:

a shaft disposed within a pump housing and coupled to at least one diaphragm;

the pump housing comprising an exhaust assembly having an exhaust chamber;

a mount removably attached at the exhaust chamber through which exhausted motive fluid exits the pump housing, the mount having a sensor receptacle wherein a portion of the sensor receptacle extends inside the exhaust chamber radially toward the shaft; and a proximity sensor received in the sensor receptacle of the mount such that a sensing end of the proximity sensor is flush with an end of the sensor receptacle nearest the shaft.

13. The diaphragm pump of claim 12, wherein motive fluid enters the pump housing at a side opposite the mount.

14. The diaphragm pump of claim 12, wherein the mount is integrally formed as one part.

15. The diaphragm pump of claim 12, wherein the mount comprises a muffler.

16. The diaphragm pump of claim 15, wherein the mount and muffler are integrally formed as one part.

* * * * *